US012527408B2

(12) United States Patent
Wang et al.

(10) Patent No.: US 12,527,408 B2
(45) Date of Patent: Jan. 20, 2026

(54) DRIVING MECHANISM AND ADJUSTABLE BED THEREWITH

(71) Applicant: Nisco Co., Ltd, Jiangsu (CN)

(72) Inventors: Wei Wang, Jiangsu (CN); Jian Xie, Jiangsu (CN); Yifan Mao, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 1095 days.

(21) Appl. No.: 17/531,910

(22) Filed: Nov. 22, 2021

(65) Prior Publication Data

US 2022/0087439 A1 Mar. 24, 2022

Related U.S. Application Data

(63) Continuation-in-part of application No. 16/867,674, filed on May 6, 2020, now Pat. No. 11,330,911.

(60) Provisional application No. 63/118,146, filed on Nov. 25, 2020, provisional application No. 62/962,324, filed on Jan. 17, 2020, provisional application No. 62/947,561, filed on Dec. 13, 2019.

(30) Foreign Application Priority Data

Nov. 20, 2020 (CN) ..... 202022718497.4

(51) Int. Cl.
*A47C 20/04* (2006.01)

(52) U.S. Cl.
CPC ..... *A47C 20/042* (2013.01); *A47C 20/041* (2013.01)

(58) Field of Classification Search
None
See application file for complete search history.

(56) References Cited

U.S. PATENT DOCUMENTS

2008/0073630 A1* 3/2008 Wu ..... H02K 16/00 254/1

FOREIGN PATENT DOCUMENTS

CN 203416995 U 2/2014
DE 102015122605 A1 * 6/2017 ..... A47C 19/005

* cited by examiner

*Primary Examiner* — Adam C Ortiz
(74) *Attorney, Agent, or Firm* — troutman pepper locke; Tim Tingkang Xia, Esq.

(57) ABSTRACT

A driving mechanism and an adjustable bed have the same. The driving mechanism includes a housing; a driving assembly being placed in the housing and comprising at least one driving member and at least one driving block connected to the at least one driving member; and at least one transmission structure configured to connect to a lifting mechanism of the adjustable bed. The at least one transmission structure is pivotally connected to the housing and the at least one driving block, such that when the at least one driving member drives the at least one driving block to move linearly, the movement of the at least one driving block causes the at least one transmission structure to rotate.

16 Claims, 9 Drawing Sheets

DRIVING MECHANISM AND ADJUSTABLE BED THEREWITH

CROSS-REFERENCE TO RELATED PATENT APPLICATIONS

This application claims priority to and the benefit of U.S. Provisional Patent Application Ser. No. 63/118,146, filed Nov. 25, 2020, which is incorporated herein in its entirety by reference.

This application also is a continuation-in-part of U.S. patent application Ser. No. 16/867,674, filed May 6, 2020, which claims priority to and the benefit of U.S. Provisional Patent Application Ser. Nos. 62/947,561, filed Dec. 13, 2019 and 62/962,324, filed Jan. 17, 2020, which are incorporated herein in their entireties by reference.

This application also claims priority to and benefit of Chinese Patent Application No. 202022718497.4, filed Nov. 20, 2020, which is incorporated herein in its entirety by reference.

FIELD OF THE INVENTION

The invention generally relates to a bed, and more particular to a driving mechanism and an adjustable bed with the driving mechanism.

BACKGROUND OF THE INVENTION

Sleep is critical for people in every aspect of their lives. Beds are necessary furniture for people to sleep on. A conventional bed usually has a fixed size, such as a king size, a queen size or a full size, which cannot be changed, without body positions adjustable, and also requires professionals to install. Thus, it is beneficial and desirable for people to have a bed system that is capable of adjusting body positions based on user's sleep preference so that the user achieves maximum comfort during sleep. In addition, it is also beneficial and desirable that the bed system can be easily assembled to improve assembly efficiency and increase the user's assembly experience. It is further beneficial and desirable that the size of the bed system can be changeable from one size to another size.

SUMMARY OF THE INVENTION

In one aspect, the invention relates to a driving mechanism for an adjustable bed. The driving mechanism comprises a housing; a driving assembly comprising at least one driving member and at least one driving block connected to the at least one driving member, wherein the driving assembly is placed in the housing; and at least one transmission structure configured to connect to a lifting mechanism of the adjustable bed, wherein the at least one transmission structure is pivotally connected to the housing and the at least one driving block, such that when the at least one driving member drives the at least one driving block to move linearly, the movement of the at least one driving block causes the at least one transmission structure to rotate.

In one embodiment, the at least one driving member comprises at least one electric push rod having an end that is telescopically movable, the telescopic end of the at least one electric push rod is connected with the at least one driving block.

In one embodiment, the at least one driving member comprises at least one motor, and the at least one motor is connected to the at least one driving block through a threaded screw mechanism.

In one embodiment, the at least one transmission structure comprises a back transmission structure and a leg transmission structure symmetrically arranged at and pivotally connected to two ends of the housing, respectively; the at least one driving member comprises a back driving member and a leg driving member; and the at least one driving block comprises a back driving block and a leg driving block, wherein the back and leg transmission structures are pivotally connected to the back and leg driving blocks, respectively, which in turn, are connected to the back and leg driving members, respectively.

In one embodiment, each of the back and leg transmission structures comprises a connecting rod, a connecting bracket, and a hinge tab fixed to a bottom of the connecting bracket, wherein one end of the connecting rod is pivotally connected to a respective one of the back and leg driving blocks, the other end of the connecting rod is pivotally connected to the hinge tab, the connecting bracket is pivotally connected to the housing.

In one aspect, the invention relates to an adjustable bed comprising a pair of side rails transversely spaced, longitudinally aligned and arranged parallel to each other; a lifting mechanism; and a pair of driving mechanisms detachably attached to the pair of side rails respectively and pivotally connected to the lifting mechanism.

Each driving mechanism comprises a housing; a driving assembly comprising at least one driving member and at least one driving block connected to the at least one driving member, wherein the driving assembly is placed in the housing; and at least one transmission structure connected to the housing, the at least one driving block and the lifting mechanism, such that when the at least one driving member drives the at least one driving block to move linearly, the movement of the at least one driving block causes the at least one transmission structure to rotate, and the rotation of the at least one transmission structure in turn drives the lifting mechanism to adjust at least one part of the adjustable bed at desired positions.

In one embodiment, each side rail comprises an enclosure configured to accommodate a respective one of the pair of driving mechanisms.

In one embodiment, the at least one driving member comprises at least one electric push rod having an end that is telescopically movable, the telescopic end of the at least one electric push rod is connected with the at least one driving block.

In one embodiment, the at least one driving member comprises at least one motor, and the at least one motor is connected to the at least one driving block through a threaded screw mechanism.

In one embodiment, the at least one transmission structure comprises a back transmission structure and a leg transmission structure symmetrically arranged at and pivotally connected to two ends of the housing, respectively; the at least one driving member comprises a back driving member and a leg driving member; and the at least one driving block comprises a back driving block and a leg driving block, wherein the back and leg transmission structures are pivotally connected to the back and leg driving blocks, respectively, which in turn, are connected to the back and leg driving members, respectively.

In one embodiment, each of the back and leg transmission structures comprises a connecting rod, a connecting bracket, and a hinge tab fixed to a bottom of the connecting bracket, wherein one end of the connecting rod is pivotally connected to a respective one of the back and leg driving blocks, the other end of the connecting rod is pivotally connected to the hinge tab, the connecting bracket is pivotally connected to the housing.

In one embodiment, the connecting bracket is a groove-type bracket.

In one embodiment, the lifting mechanism comprises a back lifting structure and a leg lifting structure connected to the back transmission structure and the leg transmission structure, respectively.

In one embodiment, the back lifting structure comprises a back lifting arm having a lower end portion connected to the connecting bracket of the back transmission structure, and a sliding groove formed in the back lifting arm.

In one embodiment, the leg lifting structure comprises a first link, a second link and the third link pivotally connected to one to another, wherein the free end of the first link is pivotally connected to the connecting bracket of the leg transmission structure and the free end of the third link is pivotally connected to a respective one of the pair of side rails.

In one embodiment, the adjustable bed further comprises a plurality of boards coupled with the pair of driving mechanisms and the lifting mechanism such that positions of one or more of the plurality of boards are adjustable in accordance with operations of the pair of driving mechanisms.

In one embodiment, the plurality of boards comprises a back board and a waist board respectively attached to an upper portion and a lower portion of the back lifting arm such that positions and angles of the back and waist boards are adjustable according to the rotation of the back lifting arm, wherein the waist board is provided with a support member, and each end of the support member is provided with a roller, and wherein the roller is received in and is slidable along the sliding groove of the back lifting arm.

In one embodiment, the plurality of boards comprises a thigh board and a leg board respectively attached to the first link and the second link of the leg lifting structure, such that positions and angles of the thigh and leg boards are adjustable according to the rotation of the first link.

In one embodiment, the adjustable bed also comprises an upper rail and a lower rail being longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length L that is adjustable or fixed and defines a size of the adjustable bed.

According to the invention, the driving mechanism and the adjustable bed have the following beneficial effects: the driving assembly is placed in the housing, so it is convenient to install and disassemble as a whole, and there is no need to separate the parts of the driving assembly. The positioning installation improves the assembly efficiency of the adjustable bed. In addition, the swing of the transmission structure is used as the external force output of the entire driving mechanism, which is pivotally connected to the housing to increase the bearing capacity of the entire driving mechanism and avoid the direct connection of the driving block with the swing arm.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
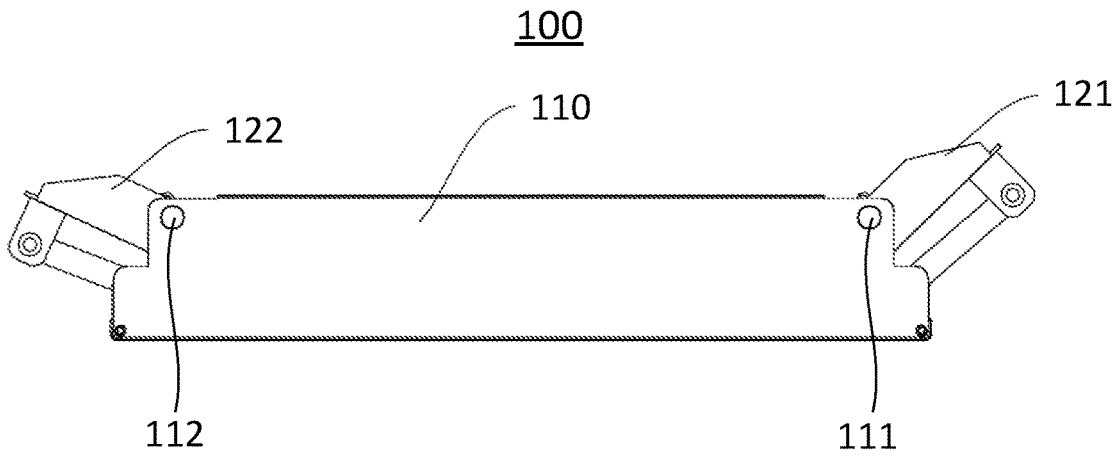
FIG. 1 shows schematically a rear elevation view of a driving mechanism according to one embodiment of the invention.

The present invention will now be described more fully hereinafter with reference to the accompanying drawings, in which exemplary embodiments of the present invention are shown. The present invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting and/or capital letters has no influence on the scope and meaning of a term; the scope and meaning of a term are the same, in the same context, whether or not it is highlighted and/or in capital letters. It will be appreciated that the same thing can be said in more than one way. Consequently, alternative language and synonyms may be used for any one or more of the terms discussed herein, nor is any special significance to be placed upon whether or not a term is elaborated or discussed herein.

Synonyms for certain terms are provided. A recital of one or more synonyms does not exclude the use of other synonyms. The use of examples anywhere in this specification, including examples of any terms discussed herein, is illustrative only and in no way limits the scope and meaning of the invention or of any exemplified term. Likewise, the invention is not limited to various embodiments given in this specification.

The terminology used herein is for the purpose of describing particular embodiments only and is not intended to be limiting of the invention. As used herein, the singular forms "a," "an," and "the" are intended to include the plural forms as well, unless the context clearly indicates otherwise.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" to another feature may have portions that overlap or underlie the adjacent feature.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below can be termed a second element, component, region, layer or section without departing from the teachings of the present invention.

Furthermore, relative terms, such as "lower" or "bottom" and "upper" or "top," may be used herein to describe one element's relationship to another element as illustrated in the figures. It will be understood that relative terms are intended to encompass different orientations of the device in addition to the orientation shown in the figures. For example, if the device in one of the figures is turned over, elements described as being on the "lower" side of other elements would then be oriented on the "upper" sides of the other elements. The exemplary term "lower" can, therefore, encompass both an orientation of lower and upper, depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

It will be further understood that the terms "comprise(s)" and/or "comprising," or "include(s)" and/or "including" or "has (have)" and/or "having" or "contain(s)" and/or "containing" when used in this specification specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, "around," "about," "substantially" or "approximately" shall generally mean within 20 percent, preferably within 10 percent, and more preferably within 5 percent of a given value or range. Numerical quantities given herein are approximate, meaning that the terms "around," "about," "substantially" or "approximately" can be inferred if not expressly stated.

As used in this specification, the phrase "at least one of A, B, and C" should be construed to mean a logical (A or B or C), using a non-exclusive logical OR. As used herein, the term "and/or" includes any and all combinations of one or more of the associated listed items.

Embodiments of the invention are illustrated in detail hereinafter with reference to accompanying drawings. The description below is merely illustrative in nature and is in no way intended to limit the invention, its application, or uses. The broad teachings of the invention can be implemented in a variety of forms. Therefore, while this invention includes particular examples, the true scope of the invention should not be so limited since other modifications will become apparent upon a study of the drawings, the specification, and the following claims. For purposes of clarity, the same reference numbers will be used in the drawings to identify similar elements. It should be understood that one or more steps within a method may be executed in different order (or concurrently) without altering the principles of the invention.

The description will be made as to the embodiments of the invention in conjunction with the accompanying drawings in FIGS. 1-13. In accordance with the purposes of this invention, as embodied and broadly described herein, this invention, in one aspect, relates to a driving mechanism and an adjustable bed with the driving mechanism.

FIGS. 1-4 show a driving mechanism 100 according to one embodiment of the invention. In this exemplary embodiment, the driving mechanism 100 includes a housing 110, a driving assembly placed in the housing, and at least one transmission structure 121/122 coupled with the driving assembly. The at least one transmission structure 121/122 is configured to connect to a lifting mechanism of an adjustable bed (FIGS. 5-13). It should be noted that the driving mechanism 100 is also known as a lifting assembly, or a power-driven lifting assembly, and the transmission structure 121/122 is also known as a transmission frame or an activation member.

The driving assembly comprises at least one driving member 131/132 and at least one driving block 151/152 connected to the at least one driving member 131/132. The at least one transmission structure 121/122 is pivotally connected to the housing 110 and the at least one driving block 151/152, such that when the at least one driving member 131/132 drives the at least one driving block 151/152 to move linearly, the movement of the at least one driving block 151/152 causes the at least one transmission structure 121/122 to rotate.

In the exemplary embodiment, the driving assembly is placed in the housing, so it is easy to install and disassemble as a whole. There is no need to position and install different components in the driving assembly separately, which improves the installation efficiency of the adjustable bed. In addition, the swing/rotation of the transmission structure is used as an external output force and the entire driving assembly is pivotally connected to the housing, which improves the bearing capacity of the entire driving mechanism and avoids the direct connection of the driving assembly with the lifting mechanism of the adjustable bed.

In order to facilitate the linear movement of the at least one driving block 151/152, the at least one driving member in one embodiment may comprise at least one electric push rod having an end that is telescopically movable, and the telescopic end of the at least one electric push rod is connected with the at least one driving block 151/152. In another embodiment, the at least one driving member includes at least one motor 131/132. The at least one motor 131/132 is connected to the driving block 151/152 through at least one threaded screw mechanism 141/142 to realize the linear movement of the at least one driving block 151/152. In some embodiments, the at least one driving member, as a driving source, can be any driving means, which is not limited to an electric push rod or a motor, being capable of driving the at least one driving block 151/152 to move linearly.

Figure 12:
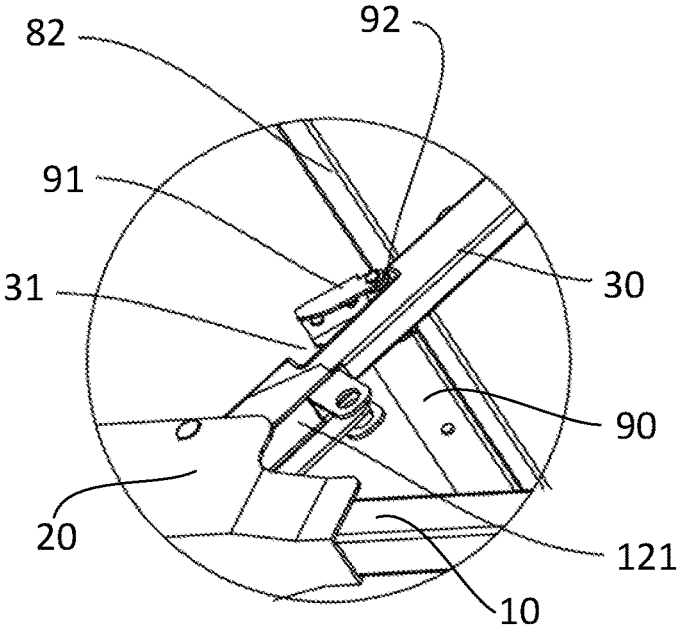
FIG. 12 shows schematically a partially enlarged review of the adjustable bed shown in FIG. 11.
Figure 13:
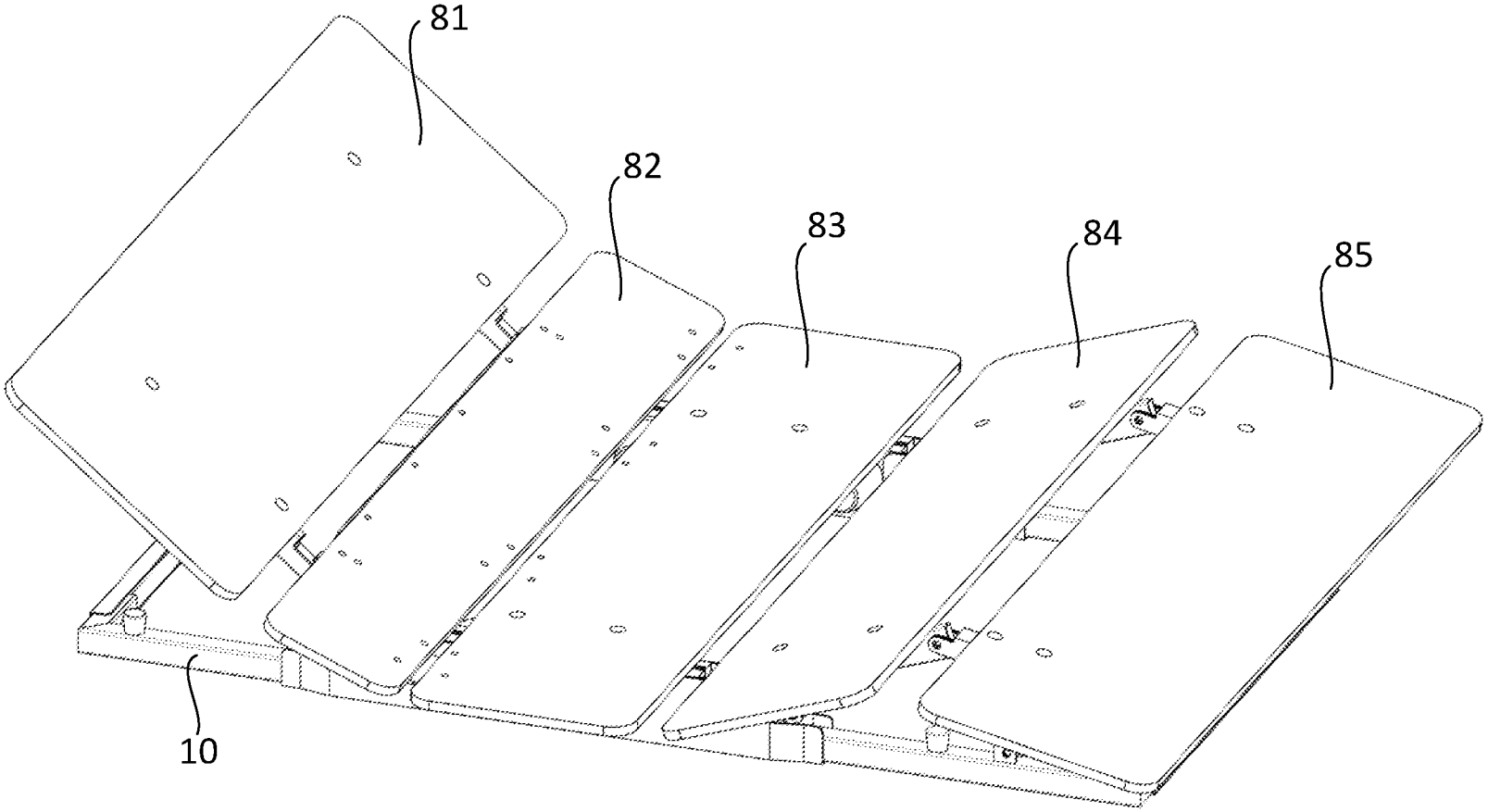
FIG. 13 shows schematically a front perspective view of the adjustable bed shown in FIG. 5 in the adjusted state.

In order to achieve bidirectional driving of the lifting mechanism including a back lifting structure and a leg lifting structure, so as to adjust positions and angles of multiple boards of an adjustable bed shown in FIGS. 12-13, each of the at least one driving member, the at least one driving block, and the at least one transmission structure comprises two of it. As shown in FIGS. 1-4, the at least one transmission structure comprises a back transmission structure 121 and a leg transmission structure 122 symmetrically arranged at two ends of the housing 110, respectively. Further, the back transmission structure 121 and the leg transmission structure 122 are pivotally connected to the two ends of the housing 110 at pivotal points 111 and 112 (FIG. 1), respectively. The at least one driving member comprises a back driving member 131 and a leg driving member 132. The at least one driving block comprises a back driving block 151 and a leg driving block 152. The back and leg transmission structures 121 and 122 are pivotally connected to the back and leg driving blocks 151 and 152, respectively, which in turn, are connected to the back and leg driving members 131 and 132 via the threaded screw rods 141 and 142, respectively. As such, the driving mechanism can realize the independent rotation control of the back and leg transmission structures 121 and 122, and can realize independent control of multiple boards of the adjustable bed, which is convenient to adjust the positions and angles of the multiple boards of the adjustable bed to meet different needs of the bed's user.

Figure 2:
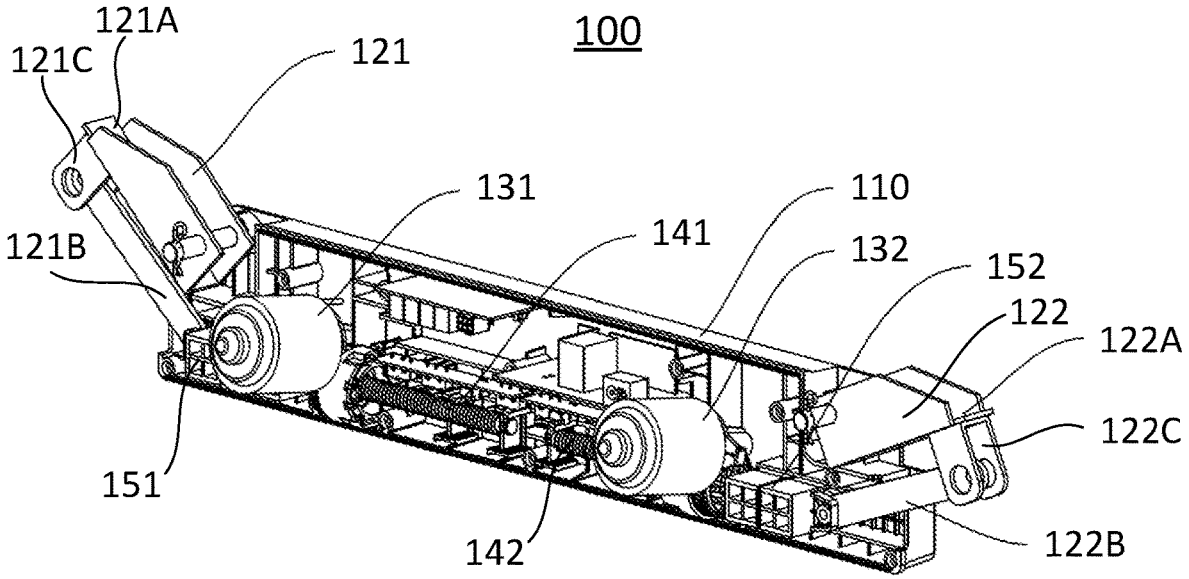
FIG. 2 shows schematically a partially perspective view of the driving mechanism shown in FIG. 1.
Figure 3:
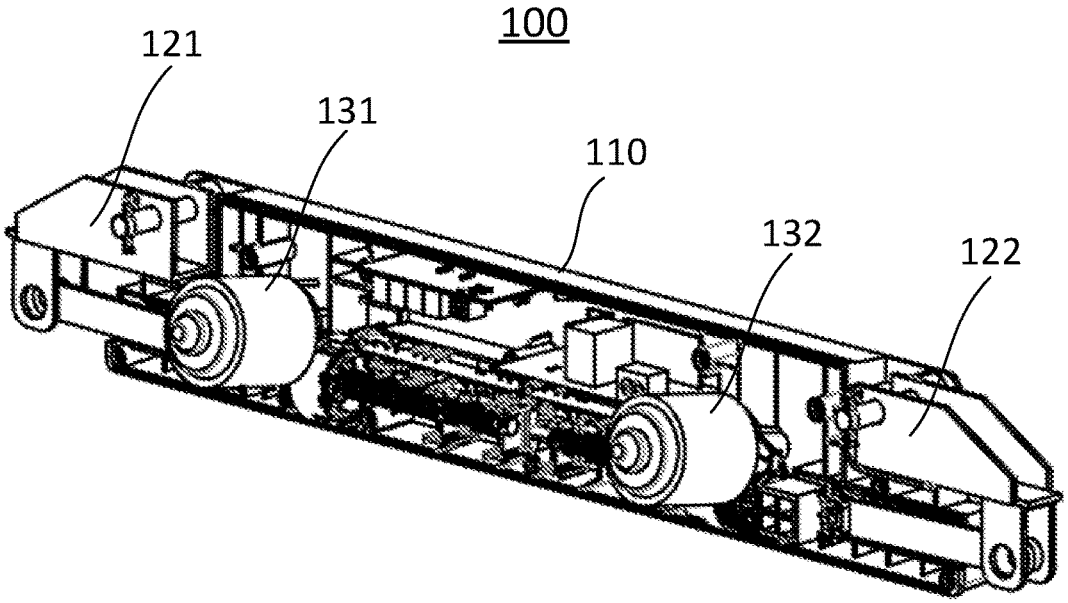
FIG. 3 shows schematically another partially perspective view of the driving mechanism shown in FIG. 1.
Figure 4:
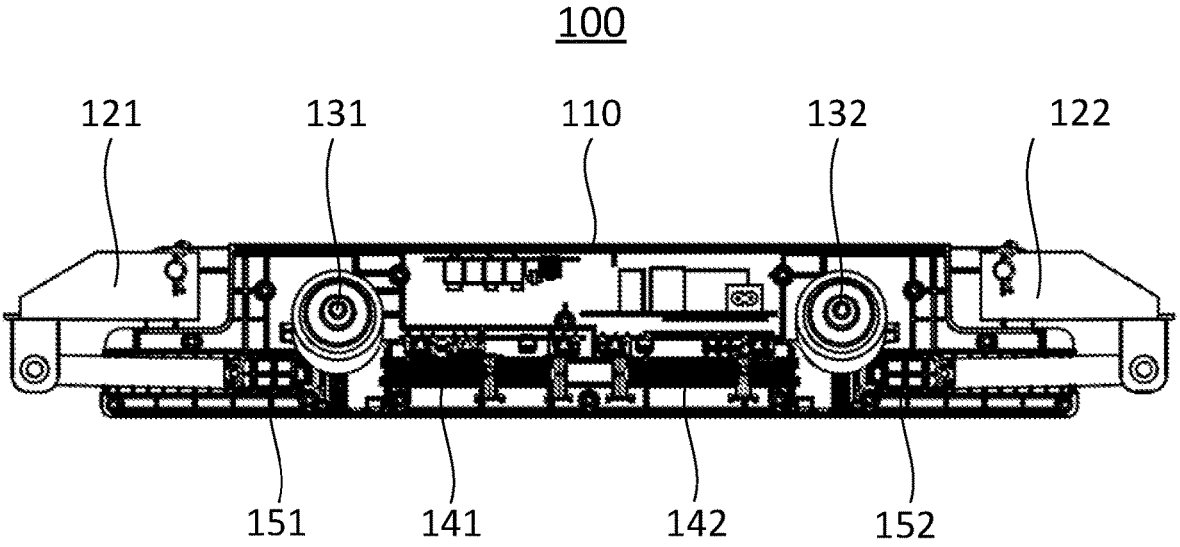
FIG. 4 shows schematically a partially front elevation view of the driving mechanism shown in FIG. 1.
Figure 7:
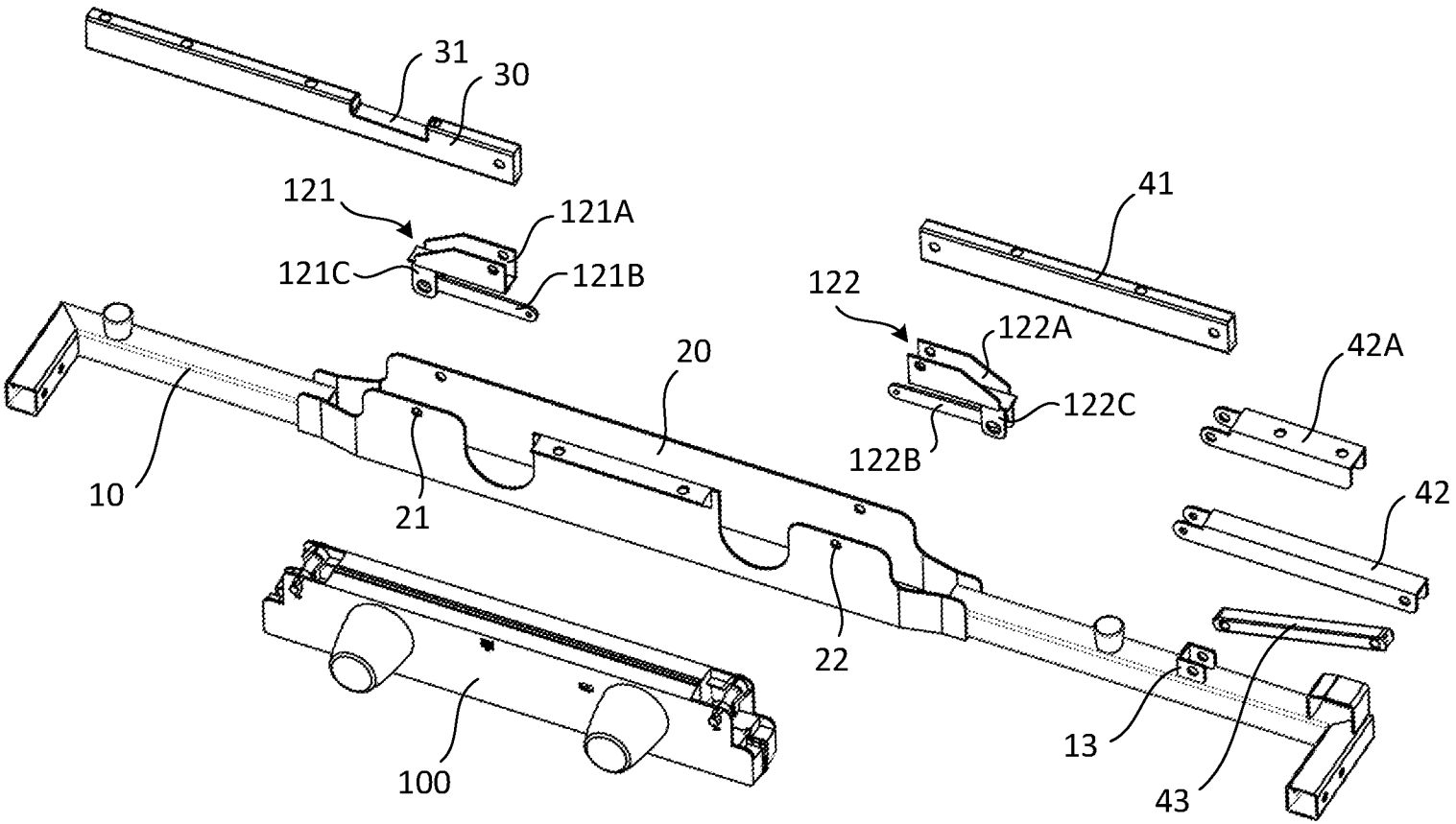
FIG. 7 shows schematically a partially exploded view of the adjustable bed shown in FIG. 5.
Figure 8:
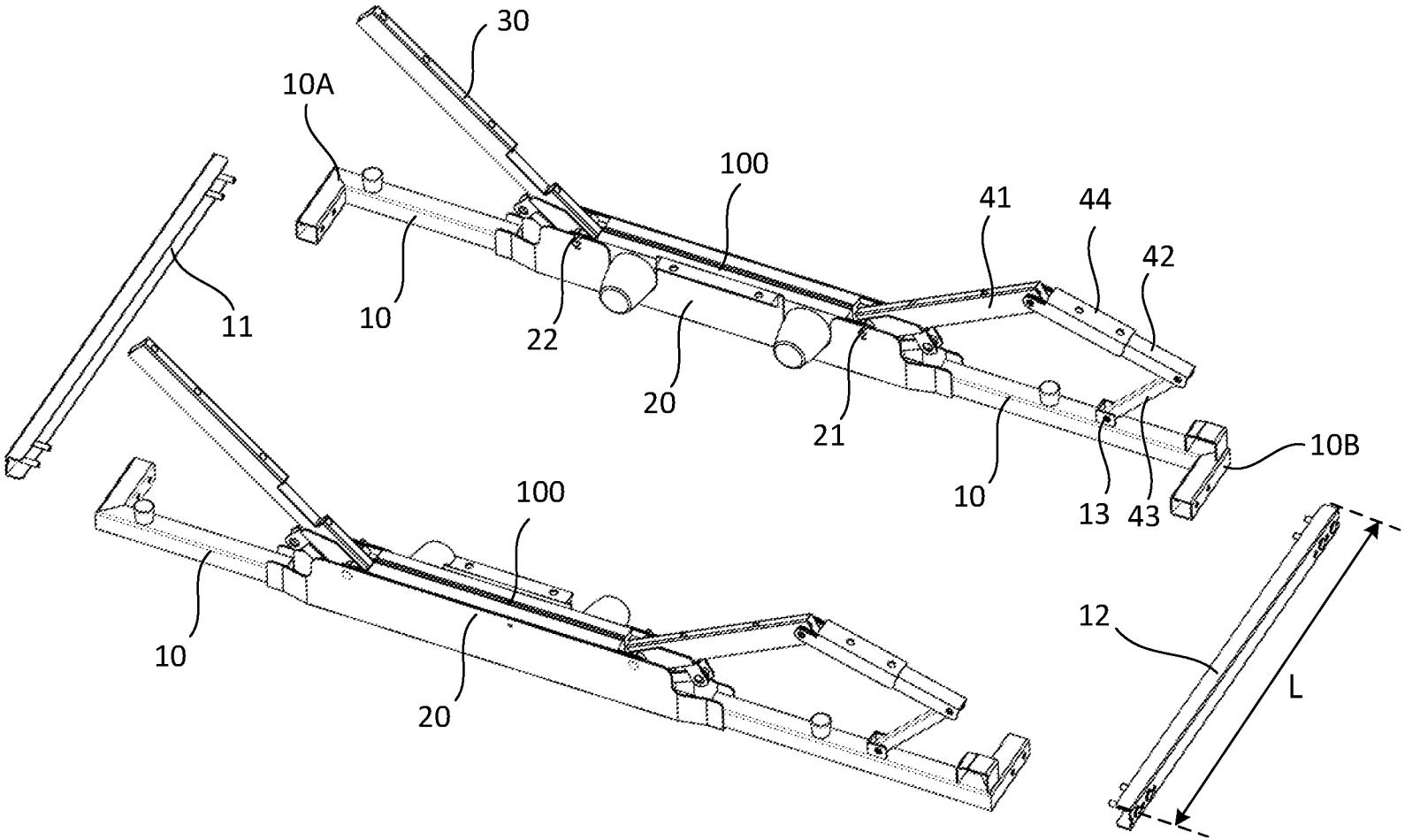
FIG. 8 shows schematically a partially perspective view of the adjustable bed shown in FIG. 5.

In order to provide a more stable supporting force, in some embodiments, each of the back and leg transmission structures 121 and 122 comprises a connecting bracket 121A/122A with a groove, a connecting rod 121B/122B, and a hinge tab 121C/122C fixed to a bottom of the connecting bracket 121A/122A, as shown in FIGS. 2 and 7. One end of the connecting rod 121B/122B is pivotally connected to a respective one of the back and leg driving blocks 151 and 152, the other end of the connecting rod 121B/122B is pivotally connected to the hinge tab 121C/122C. The connecting bracket 121A/122A is pivotally connected to the housing 110 at the pivotal point 111/112. The groove is used for accommodating a swing/lifting arm of the back lifting structure or the leg lifting structure. In one embodiment, the swing/lifting arm is connected to the driving assembly by the rotatable connecting bracket 121A/122A, and its groove is used to accommodate the swing/lifting arm to prevent the mattress from being clamped. In addition, the setting of the groove itself also provides bearing capacity for the swing/lifting arm. Compared with the bearing capacity of the hinge joint between the swing/lifting arm and the connecting bracket, the groove-shaped connecting bracket of this embodiment has a stronger bearing capacity and a more stable structure.

Referring to FIGS. 5-13, an adjustable bed is shown according to one embodiment of the invention.

In some embodiments, the adjustable bed system includes a bed frame, a pair of driving mechanisms detachably attached to bed frame, a lifting mechanism pivotally connected to the pair of driving mechanisms (also known as lifting assemblies), and a plurality of boards (also known as platforms, or bed boards, or bed platforms) coupled with the pair of driving mechanisms and the lifting mechanism such that positions of one or more of the plurality of boards are adjustable in accordance with operations of the pair of driving mechanisms.

In one embodiment shown in FIGS. 8-11, the bed frame includes a pair of side rails 10 transversely spaced, longitudinally aligned and arranged parallel to each other, and an upper rail 11 and a lower rail 12 being longitudinally spaced and transversely aligned. Two ends of the upper rail 11 are detachably connected to the first end portions 10A of the pair of side rails 10 and two ends of lower rail 12 are detachably connected to the second end portions 10B of the pair of side rails 10 such that the upper rail 11 and the lower rail 12 are parallel to each other, and the upper rail 11 and the lower rail 12 and the pair of side rails 10 are co-planar in a rectangle form. These connections can be screw-type connections or any other connection means. In the embodiment, each of the first and second end portions 10A and 10B may have reinforcing means such as a reinforcing flange or a reinforcing bar (not shown herein). In addition, each of the upper rail 11 and the lower rail 12 has a length L (FIG. 8) that is adjustable or fixed and defines a size of the bed. For example, if a user wants to convert the bed system from one size to another size, e.g., from a queen size to a king size, the user only needs to adjust the length L of the upper rail 11 and the lower rail 12 to fit the king size, or replace the queen size upper rail 11 and lower rail 12 with the king size upper rail 11 and lower rail 12.

Furthermore, each side rail 10 is provided with an enclosure 20 configured to accommodate a respective one of the pair of driving mechanisms 100. In assembly, the driving mechanism 100 is placed into the enclosure 20, and then fixed in the enclosure 20 by pins or bolts at positions 21 and 22 (FIG. 7) which are coincident with the pivotal points 111 and 112 (FIGS. 1 and 5) on the housing 110.

In one embodiment, each of the pair of driving mechanisms is same as the driving mechanism 100 as shown in FIGS. 1-4 and its details are referred to the above description of the driving mechanism 100.

Each driving mechanism 100 is detachably attached to a respective one of the pair of side rails 10 for operably adjusting positions and angles of at least one board of the adjustable bed. In one embodiment, each driving mechanism 100 is detachably placed/accommodated in the enclosure 20 of the respective side rail 10. Such an embodiment makes the assembly and disassembly of the adjustable bed much easier.

In some embodiment, each driving mechanism comprises a housing; a driving assembly placed in the housing and comprising at least one driving member and at least one driving block connected to the at least one driving member; and at least one transmission structure connected to the housing, the at least one driving block and the lifting mechanism, such that when the at least one driving member drives the at least one driving block to move linearly, the movement of the at least one driving block causes the at least one transmission structure to rotate, and the rotation of the at least one transmission structure in turn drives the lifting mechanism to adjust at least one board of the adjustable bed at desired positions and angles.

In one embodiment, the driving mechanism 100 is used as a driving force to drive the movement of at least one board/platform to adjust the angle and position of the board/platform. As described above, the driving mechanism may have only one transmission structure used to drive a head board, a waist board, a thigh board, or a leg board to move, as needed. As a whole piece, it is easy to install and use, which improves the assembly efficiency of the adjustable bed. To facilitate installation, in one embodiment, a mounting enclosure 20 is provided on the bed frame 1, and the entire driving mechanism 100 is fixed in the mounting enclosure 20.

In another embodiment, the adjustment of multiple boards of the adjustable bed can be realized by arranging two driving parts, two driving blocks and two transmission structures, and all of them are placed in the housing 110, which facilitates centralized installation and disassembly, and further improves assembly efficiency. As shown in FIGS. 1-11, the at least one transmission structure comprises a back transmission structure 121 and a leg transmission structure 122 symmetrically arranged at two ends of the housing 110, respectively. Further, the back transmission structure 121 and the leg transmission structure 122 are pivotally connected to the two ends of the housing 110 at pivotal points 111 and 112 (FIG. 1), respectively. The at least one driving member comprises a back driving member 131 and a leg driving member 132, each of which includes a motor 131/132 and a threaded screw rod 141/142 coupled with the motor 131/132, as shown in FIGS. 2-6. The at least one driving block comprises a back driving block 151 and a leg driving block 152. The back and leg transmission structures 121 and 122 are pivotally connected to the back and leg driving blocks 151 and 152, respectively, which in turn, are connected to the back and leg driving members (e.g., motors) 131 and 132 via the threaded screw rods 141 and 142, respectively. As such, the driving mechanism can realize the independent rotation control of the back and leg transmission structures 121 and 122, and can realize independent control of multiple boards of the adjustable bed, which is convenient to adjust the positions and angles of the multiple boards of the adjustable bed to meet different needs of the bed's user.

Figure 5:
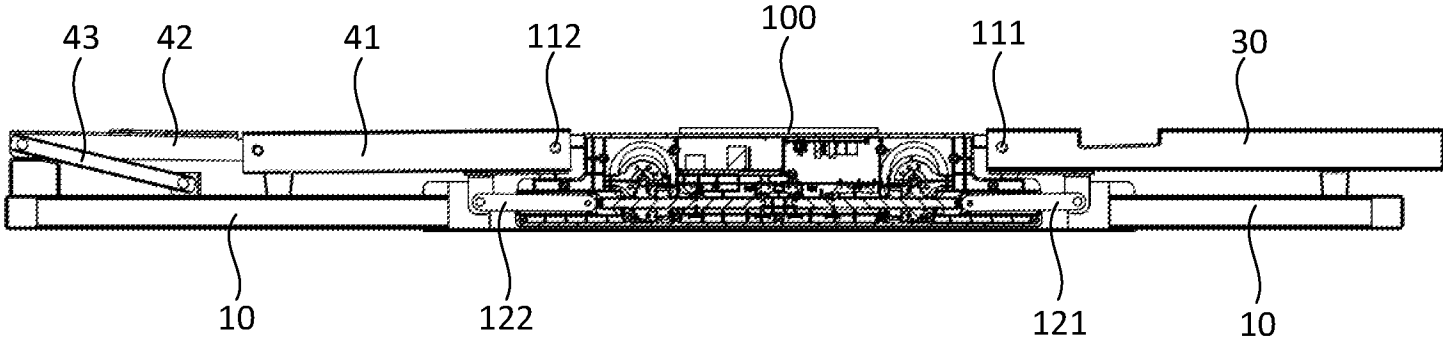
FIG. 5 shows schematically a side view of an adjustable bed in a flat/plane state according to one embodiment of the invention.

Each of the back and leg transmission structures 121 and 122 comprises a connecting bracket 121A/122A with a groove, a connecting rod 121B/122B, and a hinge tab 121C/122C fixed to a bottom of the connecting bracket 121A/122A, as shown in FIGS. 2 and 7. One end of the connecting rod 121B/122B is pivotally connected to a respective one of the back and leg driving blocks 151 and 152, the other end of the connecting rod 121B/122B is pivotally connected to the hinge tab 121C/122C. The connecting bracket 121A/122A is pivotally connected to the housing 110 at the pivotal point 111/112 (FIGS. 1 and 5). The groove is used for accommodating a swing/lifting arm 30/41 of the back lifting structure or the leg lifting structure. In one embodiment, the swing/lifting arm 30/41 is connected to the driving assembly by the rotatable connecting bracket 121A/122A, and its groove is used to accommodate the swing/lifting arm 30/41 to prevent the mattress from being clamped. In addition, the setting of the groove itself also provides bearing capacity for the swing/lifting arm 30/41. Compared with the bearing capacity of the hinge joint between the swing/lifting arm and the connecting bracket, the groove-shaped connecting bracket of this embodiment has a stronger bearing capacity and a more stable structure.

The lifting mechanism comprises a back lifting structure and a leg lifting structure connected to the back transmission structure 121 and the leg transmission structure 122, respectively.

As shown in FIG. 7, the back lifting structure comprises a back lifting arm 30 having a lower end portion connected to the connecting bracket 121A of the back transmission structure 121, and a sliding groove 31 formed in the back lifting arm 30. In one embodiment shown in FIGS. 11-13, the plurality of boards comprises a back board 81 and a waist board 82 respectively attached to an upper portion and a lower portion of the back lifting arm 30 such that positions and angles of the back and waist boards 81 and 82 are adjustable according to the rotation of the back lifting arm 30.

Figure 6:
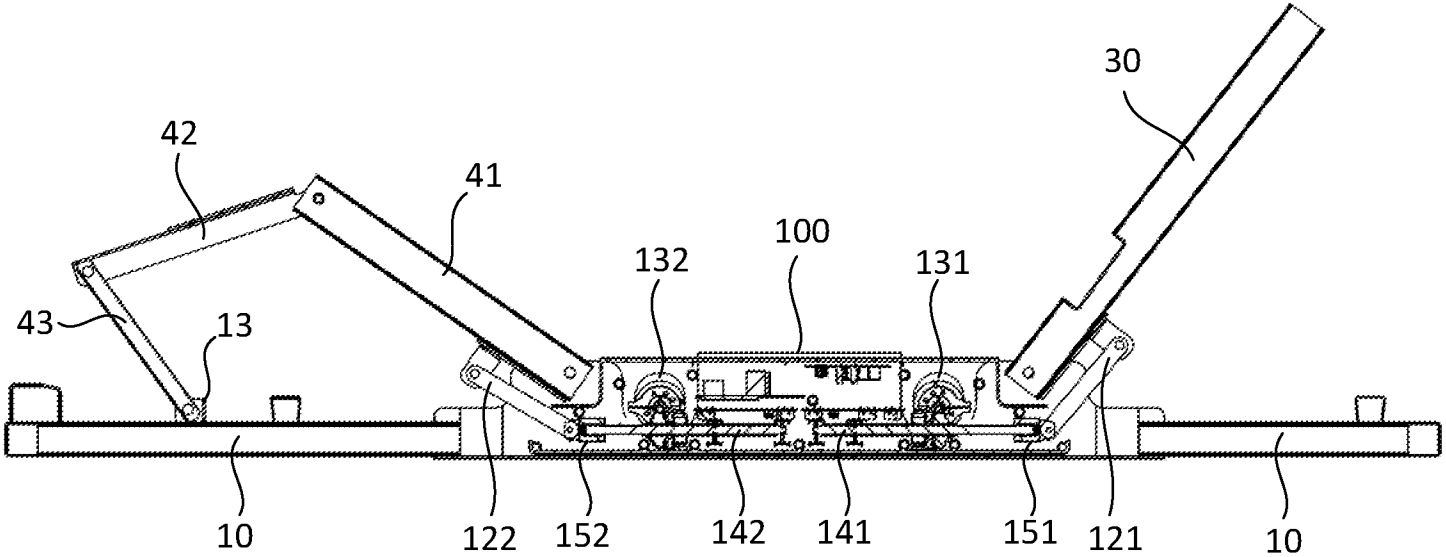
FIG. 6 shows schematically a side view of the adjustable bed shown in FIG. 5 in an adjusted state.

In operation, when the back driving motor 131 drives, via the threaded screw rod 141, the driving block 151 to move linearly, the movement of the driving block 151 in turn drives the back transmission structure 121 to rotate, and the rotation of the back transmission structure 121 causes the back swing/lifting arm 30 to rotate around the pivotal point 111 (FIG. 5), thereby adjusting the positions and angles of the head board 81 and the waist board 82 accordingly. For example, when the movement of the driving block 151 is towards the end of the housing 110 that is proximal to the driving block 151, the back swing/lifting arm 30 rotates in a upward direction, which lifts the back board 81 and the waist board 82 in a lifted (i.e., adjusted) position, as shown in FIG. 6. Reversely, when the movement of the driving block 151 is outwards the end of the housing 110 that is proximal to the driving block 151, the back swing/lifting arm 30 rotates in a downward direction, which places the back board 81 and the waist board 82 in a flat (i.e., plane) position, as shown in FIG. 5.

Figure 9:
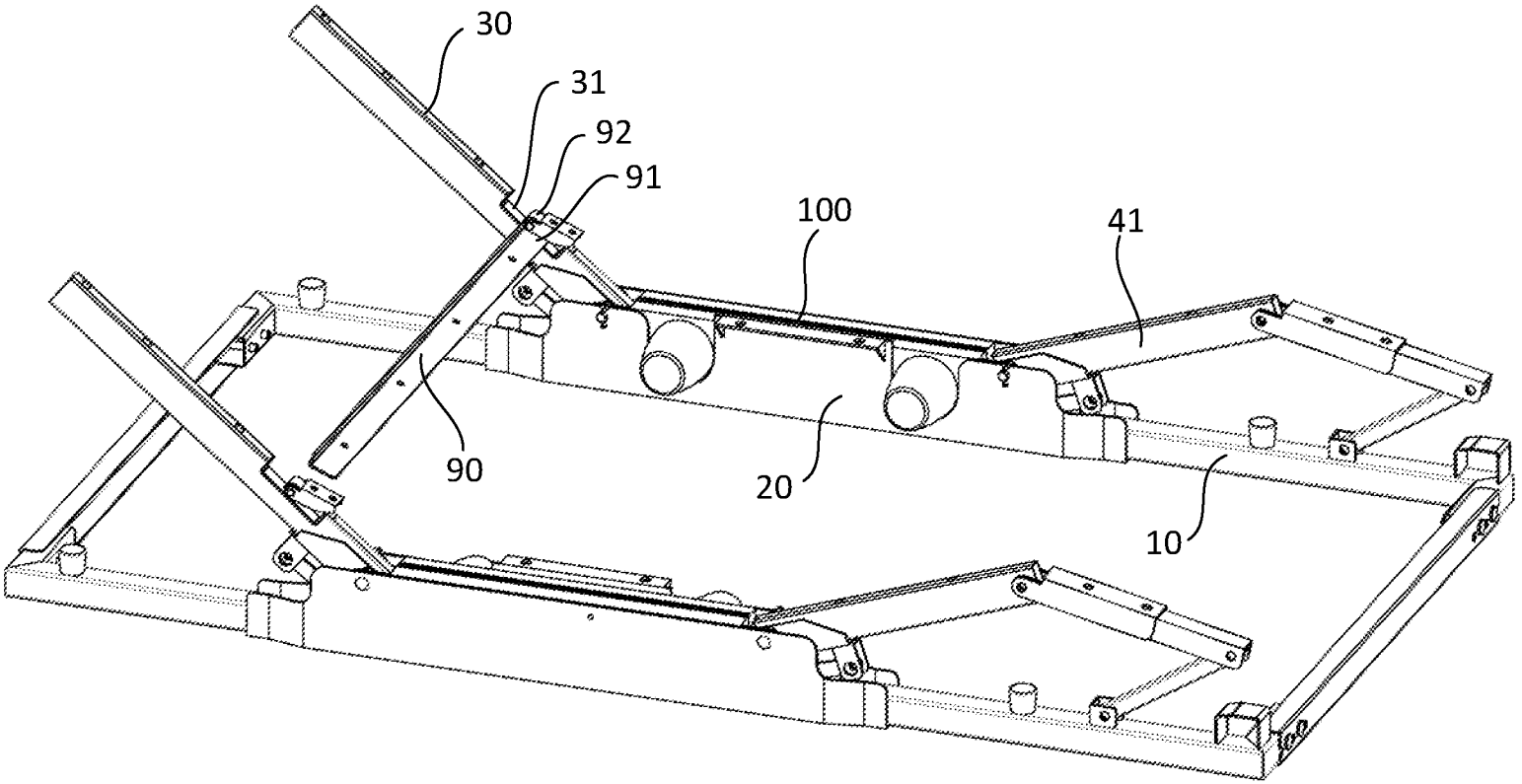
FIG. 9 shows schematically another perspective view of the adjustable bed shown in FIG. 5 in the adjusted state.
Figure 10:
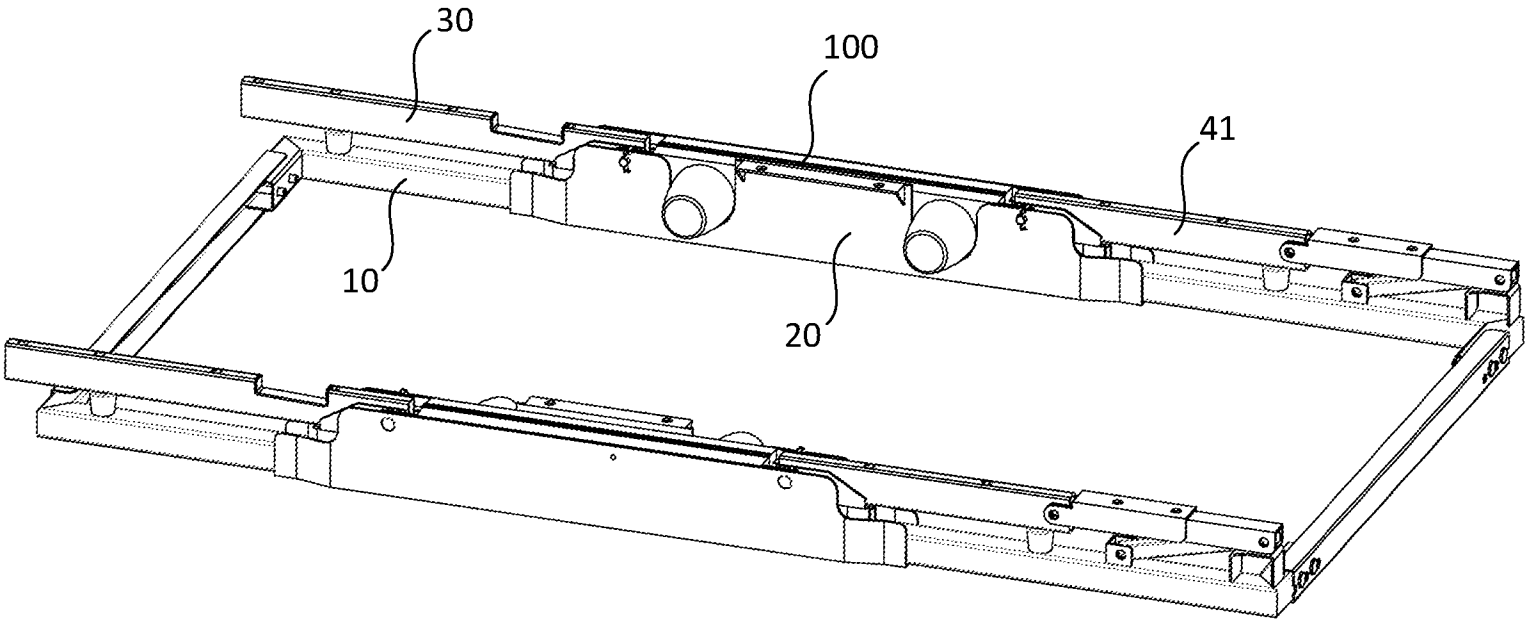
FIG. 10 shows schematically yet another perspective view of the adjustable bed shown in FIG. 5 in the flat/plane state.
Figure 11:
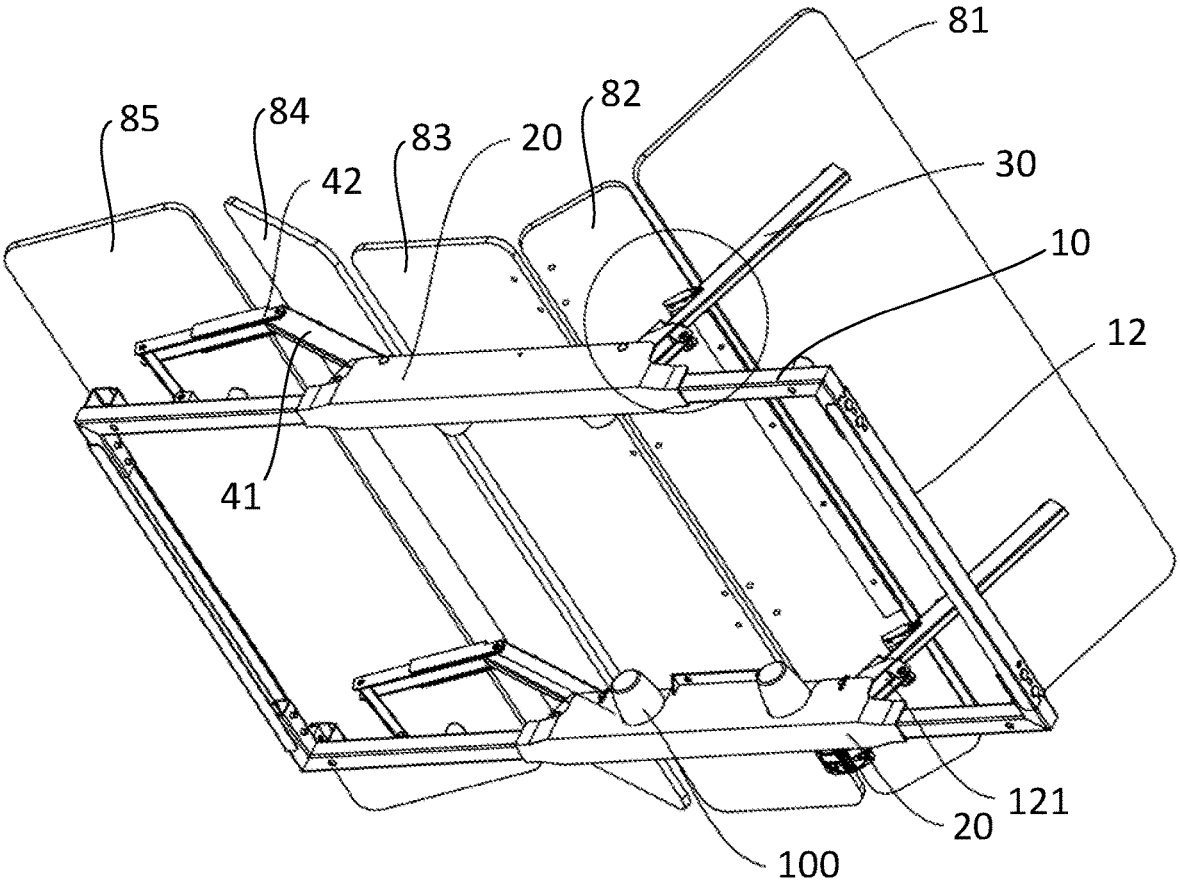
FIG. 11 shows schematically a rear perspective view of the adjustable bed shown in FIG. 5 in the adjusted state.

In order to better adjust the waist board 82, the embodiment adopts the structure of rollers 92 and sliding grooves 31 to realize the lifting and sliding of the waist board 82 while lifting the head board 81. As shown in FIGS. 9 and 11-12, the waist board 82 is provided with a support member 90 attached to the bottom surface of the waist board 82, and each end 91 of the support member 90 is provided with a roller 92. The roller 92 is received in and is slidable along the sliding groove 31 of the back lifting arm 30. Such an arrangement can realize the stable raising of the waist board 82.

In one embodiment as shown in FIGS. 7-11, the leg lifting structure comprises a first link 41, a second link 42 and the third link 43 pivotally connected to one to another. The free end of the first link 41 is pivotally connected to the connecting bracket 122A of the leg transmission structure 122 and the free end of the third link 43 is pivotally connected to a respective one of the pair of side rails 10 at a pivotal bracket 13 (FIG. 7). The plurality of boards comprises a thigh board 84 and a leg board 85 respectively attached to the first link 41 and the second link 42 of the leg lifting structure, such that positions and angles of the thigh and leg boards 84 and 85 are adjustable according to the rotation of the first link 41. In addition, the second link 82 is also provided with a groove bracket 42A (FIG. 7).

In operation, when the leg driving motor 132 drives, via the threaded screw rod 142, the driving block 152 to move linearly, the movement of the driving block 152 in turn drives the leg transmission structure 122 to rotate, and the rotation of the leg transmission structure 122 causes the first link 41 to rotate around the pivotal point 112 (FIG. 5), thereby adjusting the positions and angles of the thigh board 84 and the leg board 85 accordingly. For example, when the movement of the driving block 152 is towards the end of the housing 110 that is proximal to the driving block 152, the back first link 41 rotates in a upward direction, which lifts the second and third links 42 and 43 and thus lifts the thigh board 84 and the leg board 85 accordingly in a lifted (i.e., adjusted) position, as shown in FIG. 6. Reversely, when the movement of the driving block 152 is outwards the end of the housing 110 that is proximal to the driving block 152, the first link 41 rotates in a downward direction, which puts the second and third links 42 and 43 down and thus places the thigh board 84 and the leg board 85 in a flat (i.e., plane) position, as shown in FIG. 5.

In this exemplary embodiment, the hinged connection of the two ends of the links 41-43 makes the action of each link form a quadrilateral, which increases the support stability and at the same time realizes the change of the lifting angle of the calf board and the thigh board by changing the top angle of the quadrilateral.

In addition, the adjustable bed further includes a controller configured to control operations of the back and leg driving members 131 and 132 individually or cooperatively, so as to lift individually or cooperatively the back board 81, the waist board 82, the thigh board 84, and the leg board 85 in desired positions.

In sum, the invention provides a driving mechanism and an adjustable bed with the driving mechanism that is capable of adjusting body positions and angles based on user's sleep preference so that the user achieves maximum comfort during sleep, and can be easily assembled to improve assembly efficiency and increase the user's assembly experience. In addition, the size of the adjustable bed system can be changeable from one size to another size. Another advantage of this invention is that the drive system (i.e., the driving mechanism) and the boards/platforms are separated and thus can be packed in two cartons separately, which may reduce the inventory pressure on dealers.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. A driving mechanism for an adjustable bed, comprising:

a housing;

a driving assembly comprising at least one driving member and at least one driving block connected to the at least one driving member, wherein the driving assembly is placed in the housing; and at least one transmission structure configured to connect to a lifting mechanism of the adjustable bed, wherein the at least one transmission structure is pivotally connected to the housing and the at least one driving block, such that when the at least one driving member drives the at least one driving block to move linearly, the movement of the at least one driving block causes the at least one transmission structure to rotate, wherein the at least one transmission structure comprises:

a connecting bracket having a first end pivotally connected to the housing at a pivotal point, a second end, and a groove defined between the first end and the second end for accommodating the lifting mechanism;

a hinge tab fixed to a bottom side of the second end of the connecting bracket; and a connecting rod having a first end pivotally connected to the at least one driving block, and a second end pivotally connected to the hinge tab, wherein in operation, the movement of the at least one driving block causes the first end of the connecting rod to translationally move along with the movement of the at least one driving block, and the second end of the connecting rod to rotationally move around the hinge tab, which in turn causes the hinge tab and thus the second end of the connecting bracket to rotate around the first end of the connecting bracket at the pivotal point of the housing.

2. The driving mechanism of claim 1, wherein the at least one driving member comprises at least one electric push rod having an end that is telescopically movable, the telescopic end of the at least one electric push rod is connected with the at least one driving block.

3. The driving mechanism of claim 1, wherein the at least one driving member comprises at least one motor, and the at least one motor is connected to the at least one driving block through a threaded screw mechanism.

4. The driving mechanism of claim 1, wherein the at least one transmission structure comprises a back transmission structure and a leg transmission structure symmetrically arranged at and pivotally connected to two ends of the housing, respectively;

the at least one driving member comprises a back driving member and a leg driving member; and the at least one driving block comprises a back driving block and a leg driving block, wherein the back and leg transmission structures are pivotally connected to the back and leg driving blocks, respectively, which in turn, are connected to the back and leg driving members, respectively.

5. An adjustable bed, comprising:

a pair of side rails transversely spaced, longitudinally aligned and arranged parallel to each other;

a lifting mechanism; and a pair of driving mechanisms detachably attached to the pair of side rails respectively and pivotally connected to the lifting mechanism, wherein each driving mechanism comprises:

a housing;

a driving assembly comprising at least one driving member and at least one driving block connected to the at least one driving member, wherein the driving assembly is placed in the housing; and at least one transmission structure connected to the housing, the at least one driving block and the lifting mechanism, such that when the at least one driving member drives the at least one driving block to move linearly, the movement of the at least one driving block causes the at least one transmission structure to rotate, and the rotation of the at least one transmission structure in turn drives the lifting mechanism to adjust at least one part of the adjustable bed at desired positions, wherein the at least one transmission structure comprises:

a connecting bracket having a first end pivotally connected to the housing at a pivotal point, a second end, and a groove defined between the first end and the second end for accommodating the lifting mechanism;

a hinge tab fixed to a bottom side of the second end of the connecting bracket; and a connecting rod having a first end pivotally connected to the at least one driving block, and a second end pivotally connected to the hinge tab, wherein in operation, the movement of the at least one driving block causes the first end of the connecting rod to translationally move along with the movement of the at least one driving block, and the second end of the connecting rod to rotationally move around the hinge tab, which in turn causes the hinge tab and thus the second end of the connecting bracket to rotate around the first end of the connecting bracket at the pivotal point of the housing.

6. The adjustable bed of claim 5, wherein each side rail comprises an enclosure configured to accommodate a respective one of the pair of driving mechanisms.

7. The adjustable bed of claim 5, wherein the at least one driving member comprises at least one electric push rod having an end that is telescopically movable, the telescopic end of the at least one electric push rod is connected with the at least one driving block.

8. The adjustable bed of claim 5, wherein the at least one driving member comprises at least one motor, and the at least one motor is connected to the at least one driving block through a threaded screw mechanism.

9. The adjustable bed of claim 5, wherein the at least one transmission structure comprises a back transmission structure and a leg transmission structure symmetrically arranged at and pivotally connected to two ends of the housing, respectively;

the at least one driving member comprises a back driving member and a leg driving member; and the at least one driving block comprises a back driving block and a leg driving block, wherein the back and leg transmission structures are pivotally connected to the back and leg driving blocks, respectively, which in turn, are connected to the back and leg driving members, respectively.

10. The adjustable bed of claim 9, wherein the lifting mechanism comprises a back lifting structure and a leg lifting structure connected to the back transmission structure and the leg transmission structure, respectively.

11. The adjustable bed of claim 10, wherein the back lifting structure comprises a back lifting arm having a lower end portion connected to the connecting bracket of the back transmission structure, and a sliding groove formed in the back lifting arm.

12. The adjustable bed of claim 11, wherein the leg lifting structure comprises a first link, a second link and the third link pivotally connected to one to another, wherein the free end of the first link is pivotally connected to the connecting bracket of the leg transmission structure and the free end of the third link is pivotally connected to a respective one of the pair of side rails.

13. The adjustable bed of claim 12, further comprising a plurality of boards coupled with the pair of driving mechanisms and the lifting mechanism such that positions of one or more of the plurality of boards are adjustable in accordance with operations of the pair of driving mechanisms.

14. The adjustable bed of claim 13, wherein the plurality of boards comprises a back board and a waist board respectively attached to an upper portion and a lower portion of the back lifting arm such that positions and angles of the back and waist boards are adjustable according to the rotation of the back lifting arm, wherein the waist board is provided with a support member, and each end of the support member is provided with a roller, and wherein the roller is received in and is slidable along the sliding groove of the back lifting arm.

15. The adjustable bed of claim 13, wherein the plurality of boards comprises a thigh board and a leg board respectively attached to the first link and the second link of the leg lifting structure, such that positions and angles of the thigh and leg boards are adjustable according to the rotation of the first link.

16. The adjustable bed of claim 5, further comprising an upper rail and a lower rail being longitudinally spaced and transversely aligned, two ends of the upper rail being detachably connected to the first ends of the pair of side rails and two ends of lower rail being detachably connected to the second ends of the pair of side rails such that the upper rail and the lower rail are parallel to each other, wherein each of the upper rail and the lower rail has a length L that is adjustable or fixed and defines a size of the adjustable bed.

* * * * *